US006941082B2

(12) United States Patent
Urabe

(10) Patent No.: US 6,941,082 B2
(45) **Date of Patent: *Sep. 6, 2005**

(54) REPLACEABLE TONER CARTRIDGE FOR USE WITH AN IMAGE FORMING APPARATUS

(75) Inventor: Kenji Urabe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/860,140

(22) Filed: Jun. 4, 2004

(65) Prior Publication Data

US 2004/0218935 A1 Nov. 4, 2004

Related U.S. Application Data

(63) Continuation of application No. 10/319,697, filed on Dec. 16, 2002, now Pat. No. 6,766,119.

(51) Int. Cl.[7] ..... G03G 15/00
(52) U.S. Cl. ..... 399/12; 399/13
(58) Field of Search ..... 399/12, 13, 24, 399/27

(56) References Cited

U.S. PATENT DOCUMENTS

| | | | | |
|---|---|---|---|---|
| 4,963,939 A | | 10/1990 | Kurando et al. | 399/12 |
| 6,477,335 B1 | | 11/2002 | Surya et al. | 399/12 |
| 6,766,119 B2 | * | 7/2004 | Urabe | 399/12 |

FOREIGN PATENT DOCUMENTS

| | | |
|---|---|---|
| JP | 61-215575 A | 9/1986 |
| JP | 2000-347503 A | 12/2000 |

* cited by examiner

*Primary Examiner*—William J. Royer
(74) *Attorney, Agent, or Firm*—Foley & Lardner LLP

(57) ABSTRACT

An image forming apparatus includes a replaceable toner cartridge which, in turn, includes a magnetic chip records identifying information about the type of toner cartridge. The magnetic chip interacts with an identifying unit, to determine the compatibility of the toner cartridge. The magnetic chip is made from magnetic powder and non-magnetic powder compounded at an appropriate ratio at which a predetermined magnetic resistance is maintained. The identifying unit includes a magnetic sensor which detects magnetic resistance without contacting the magnetic chip. A microcomputer verifies whether the output detected by the magnetic sensor is greater than or equal to a predetermined level and within a range of criterion, to determine whether the toner cartridge is compatible with the image forming apparatus.

8 Claims, 4 Drawing Sheets

REPLACEABLE TONER CARTRIDGE FOR USE WITH AN IMAGE FORMING APPARATUS

CROSS-REFERENCE TO RELATED APPLICATIONS

The present application is a continuation of U.S. application Ser. No. 10/319,697, filed Dec. 16, 2002 now U.S. Pat. No. 6,766,119, the entire contents of which are incorporated herein by reference.

BACKGROUND

The present invention relates to an image forming apparatus for a copying machine, a printer and the like. More specifically, this invention relates to an image forming apparatus for installing a plurality of types of toner cartridges without confusing them in which different kinds of toner components are separately stored.

Generally, in an image forming apparatus such as a copying machine or a printer, toner replenishment is carried out by replaceable toner cartridges. The toner cartridges are designed into the shape which is adapted to a model of respective copying machine, printer and the like.

On the other hand, the kind of toner component is not limited to one but varies accordingly. Therefore, some features are adopted on the apparatus in order not to install a wrong toner cartridge by mistake when the type of toner component varies. For example, various shapes of coupling gears, which are arranged at an engagement portion of the toner cartridge and the body, are employed depending upon a model and specification. Another example is to provide a concavity and a convexity on the toner cartridge and the apparatus body respectively to fit each other. In the latter case, while the convexity is created on a toner hopper, for example, the concavity is created on the body side so that a body cover cannot be closed unless these parts fit together, thereby achieving a clarity in interrelationship between the toner cartridge and the compatible apparatus model therewith. Accordingly in the field, various shapes of the toner cartridges are being designed in accordance with an apparatus model or a toner component in order to prevent a wrong toner cartridge from being installed.

However, as mentioned above, if the shape and the like of the toner cartridge varies whenever the toner component varies, a different shape of the toner cartridge is required for each toner component, resulting in an increase in the number of the types of toner cartridges. Consequently, there arises a problem of tremendous amount of money required for development.

SUMMARY OF THE INVENTION

The object of the present invention is to provide an image forming apparatus which achieves a cost reduction by reducing the number of the types of toner cartridges.

In order to accomplish the aforementioned object, according to the present invention, an image forming apparatus which is provided with replaceable toner cartridges comprises: an identification chip, which is arranged in the aforementioned toner cartridge and in which information to identify the type and the like of the toner cartridge is recorded, and an identifying means for identifying the type and the like of the toner cartridge by reading the information of the identification chip so as to determine the compatibility of the toner cartridge.

The constitution mentioned above enables the identifying means to read the information recorded in the identification chip, which is arranged in respective toner cartridges, so as to determine whether the toner cartridge is compatible with the image forming apparatus. Accordingly, when the identification chip, which responds to the difference of toner components, is arranged on the toner cartridges with the identical shape respectively, the compatibility of the toner cartridge with the apparatus is clearly determined. This reduces the number of the types of toner cartridges.

In the image forming apparatus mentioned above, it is desirable that the aforementioned identification chip is a magnetic chip made from magnetic powder.

This constitution enables the magnetic chip to record the identifying information by means of magnetism. The identifying means reads this magnetic identifying information so as to determine whether the toner cartridge is compatible with the image forming apparatus.

In the image forming apparatus mentioned above, it is desirable that the aforementioned identification chip is a magnetic chip, which is made from magnetic powder and non-magnetic powder compounded at an appropriate ratio at which a constant magnetic resistance is maintained.

This constitution enables the magnetic chip to record the identifying information by means of magnetic resistance. The identifying means detects this magnetic resistance so as to determine whether the toner cartridge is compatible with the image forming apparatus.

In the image forming apparatus mentioned above, the identifying means comprises a magnetic sensor for detecting magnetic resistance without contacting with the identification chip.

This constitution enables the magnetic sensor to detect magnetic resistance without contacting with the identification chip. The identification chip here is configured to a predetermined magnetic resistance for the magnetic sensor to detect, thereby contributing to a simple construction and assembly of the apparatus. Furthermore, as the magnetic sensor detects magnetic resistance without contacting with the identification chip, a prolonged use does not cause abrasion and the like, thus assuring a stable functionality and improved reliability.

It is desirable that the magnetic sensor verifies whether the magnetic resistance detected thereby is higher than or equal to the predetermined magnetic resistance so as to determine whether the toner cartridge has been installed to the apparatus.

The above constitution enables an easy and accurate determination of the magnetic sensor about the installation of the toner cartridge.

It is desirable that the magnetic sensor verifies whether the magnetic resistance detected thereby is higher than or equal to the predetermined magnetic resistance and within the range of criterion so as to determine whether the aforementioned toner cartridge is compatible with the apparatus.

The above constitution enables the magnetic sensor to determine that the toner cartridge has been installed to the image forming apparatus when the magnetic resistance detected by the magnetic sensor is higher than or equal to the predetermined magnetic resistance, and further determines that the installed toner cartridge is compatible with the apparatus when the magnetic resistance detected by the magnetic sensor is within the range of criterion. Accordingly an easy and accurate determination of the magnetic sensor about the installation of the toner cartridge and compatibility thereof with the image forming apparatus can be achieved.

DETAILED DESCRIPTION

With reference to the attached drawings, the preferred embodiment of an image forming apparatus in accordance with the present invention will be described below.

Figure 2:
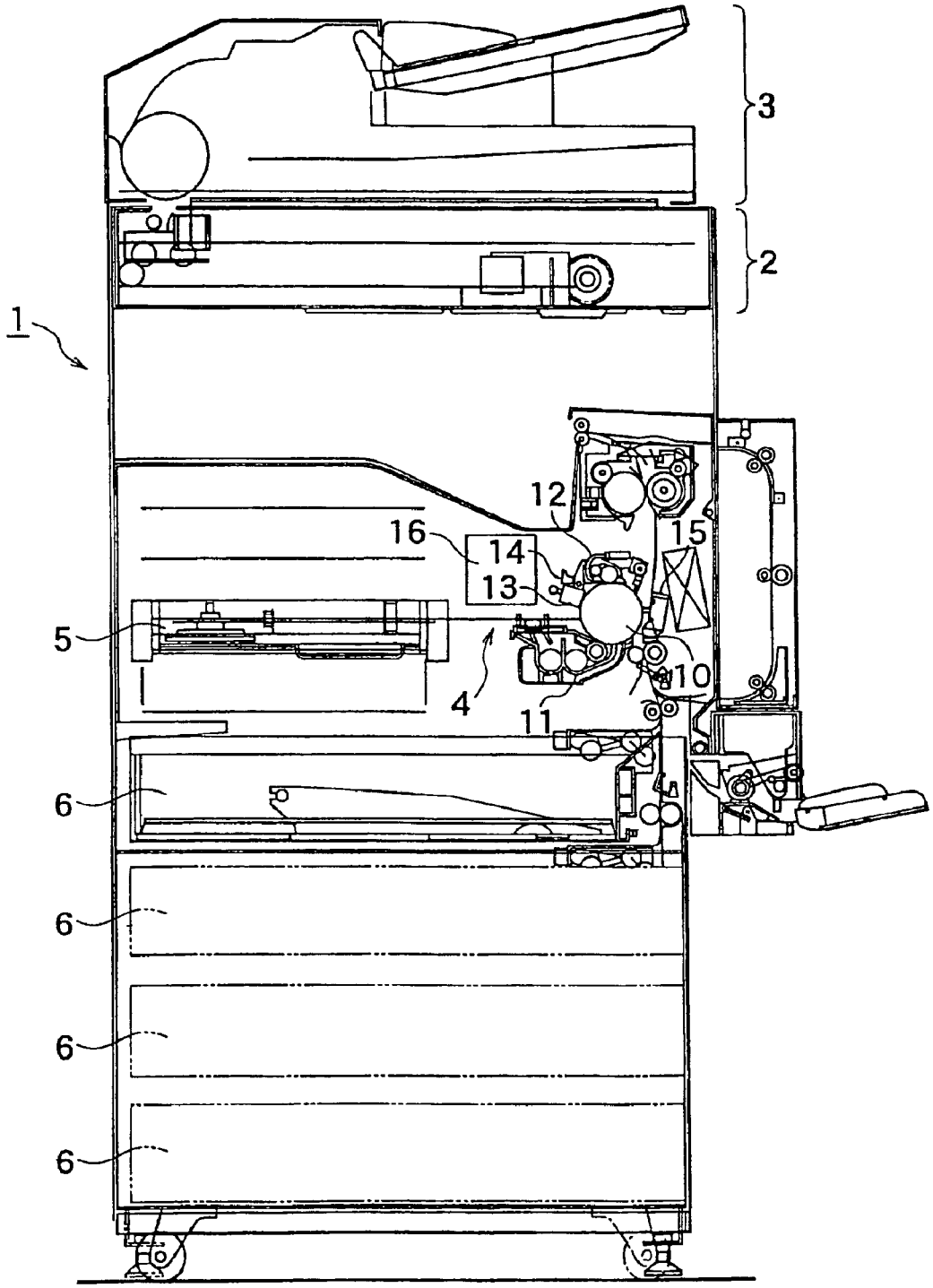
FIG. 2 is a sectional view of a preferred embodiment of an image forming apparatus in accordance with the present invention.

As shown in FIG. 2, the image forming apparatus 1 mainly comprises an image reading part 2, an automatic paper-feeding device 3, an image storing part (not shown), an image forming part 4 and a laser optical device 5. Under the laser optical device 5, a plurality of paper trays 6 are arranged, in which different sizes of printing paper are stored respectively.

The image reading part 2 is provided for reading an image on the surface of an original to be copied by exposing the image on the surface of the original to light so as to convert the image on the surface of the original into an electrical signal. The automatic paper-feeding device 3 is provided for conveying supplied paper automatically to the image reading part 2. The image storing part mentioned above is a device for capturing and storing image data, which is read by the image reading part 2, which outputs the data when necessary.

The image forming part 4 is provided for forming an image on the basis of the image data, which is stored in the image storing part. The image forming part 4 mainly comprises a photosensitive drum 10 which partially removes electrification on the surface of a sheet of paper with a laser beam in accordance with the image data, a developing device 11 which causes toner to adhere to the surface of the charged photosensitive drum 10 in accordance with the image data so as to develop an image, a cleaner 12 which removes the toner remaining on the surface of the photosensitive drum 10, an electrifying charger 13 which charges the surface of the photosensitive drum 10, a de-electrifying lamp 14 which removes electrification on the surface of the photosensitive drum 10 and a transferring/peeling charger 15.

The laser optical device 5 is provided for emitting a laser beam on the surface of the photosensitive drum 10 of the image forming part 4 on the basis of the image data. The laser optical device 5 extracts the image data which is stored in the image storing part, and emits the laser beam on the surface of the photosensitive drum 10 of the image forming part 4 so as to form a visible image.

Figure 1:
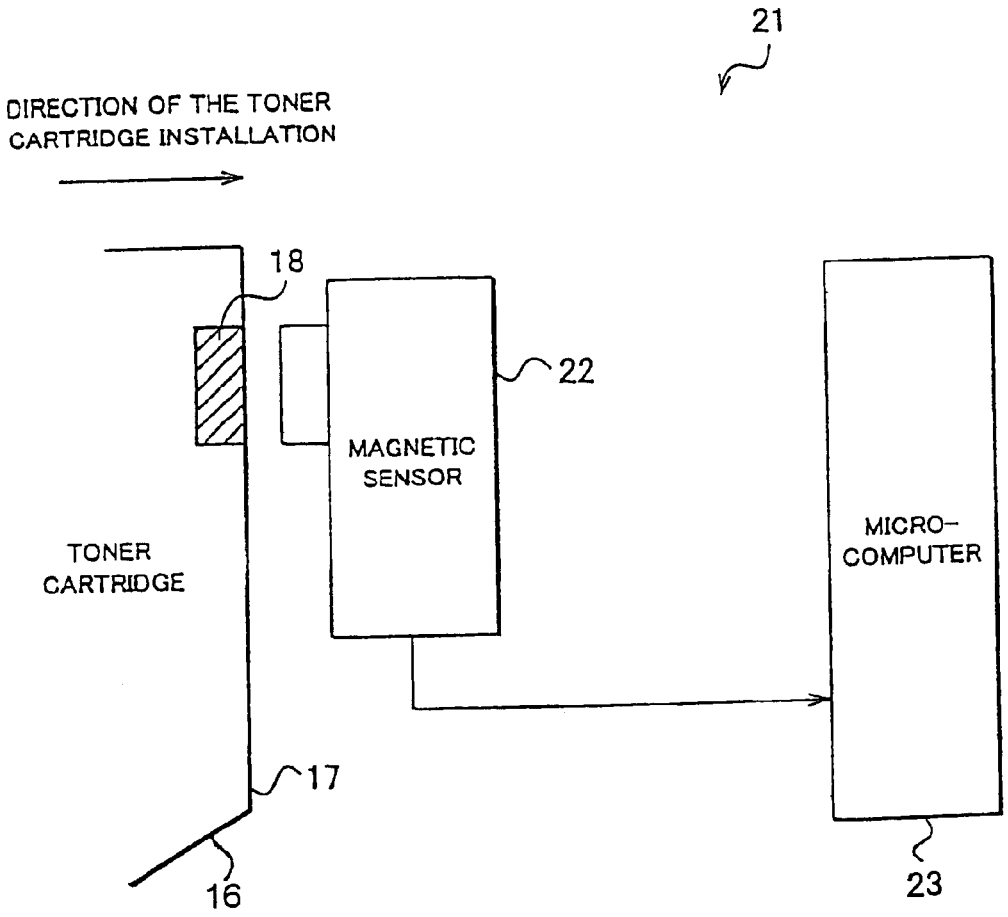
FIG. 1 is a schematic diagram showing a principal part of a preferred embodiment of an image forming apparatus in accordance with the present invention.

The developing device 11 mentioned above is provided with a toner cartridge 16. As shown in FIG. 1, the toner cartridge 16 comprises a container body 17 for storing toner, and a magnetic chip 18 attached thereto.

The container body 17 is a general container made of plastics and the like, which is formed into the shape to adapt to an engagement portion of the body of the image forming apparatus 1.

The magnetic chip 18 is provided for recording identifying information about the toner cartridge 16 such as the type of the toner cartridge 16. The magnetic chip 18 is embedded in an inner wall of the toner cartridge 16. It is made from a compound of magnetic powder and non-magnetic powder, formed into the shape of a coin. These two kinds of powder are compounded at a ratio at which constant magnetic resistance is maintained. When a toner cartridge 16 is deeply inserted into the engagement portion of the body of the image forming apparatus 1, the toner cartridge 16 is designed to be located in a position facing a magnetic sensor 22 of an identifying means 21, which will be described later, for determining whether the inserted toner cartridge 16 is compatible with the image forming apparatus 1.

The image forming apparatus 1 is provided with the identifying means 21. The identifying means 21 is a means for identifying the type thereof and the like of a toner cartridge 16 by way of reading identifying information of the magnetic chip 18, so as to determine whether the proper toner cartridge 16 has been inserted. The identifying means 21 comprises a magnetic sensor 22 for detecting magnetic resistance without contacting with the magnetic chip 18, and a microcomputer 23 serving as a means for determination.

The magnetic sensor 22 is arranged on the most inner wall of the engagement portion of the body of the imaging apparatus 1. Specifically, the magnetic sensor 22 is located in a position facing the magnetic chip 18 of the toner cartridge 16 when the toner cartridge 16 is inserted deeply into the engagement portion of the body of the image forming apparatus 1.

The microcomputer 23 specifically is a device for determining the compatibility of the toner cartridge 16 with the image forming apparatus 1. The microcomputer 23 first verifies whether the magnetic resistance detected by the magnetic sensor 22 is higher than or equal to a predetermined level so as to determine whether the toner cartridge 16 has been installed. Then, it proceeds to verify whether the output detected by the magnetic sensor 22 is higher than or equal to the predetermined level and within a range of criterion so as to determine whether the inserted toner cartridge 16 is compatible with the image forming apparatus 1. The microcomputer 23 is incorporated in an operating panel (not shown), which is available to the users for operation.

The relationship between the magnetic chip 18 and the output voltage of the magnetic sensor 22 is described below.

Figure 3:
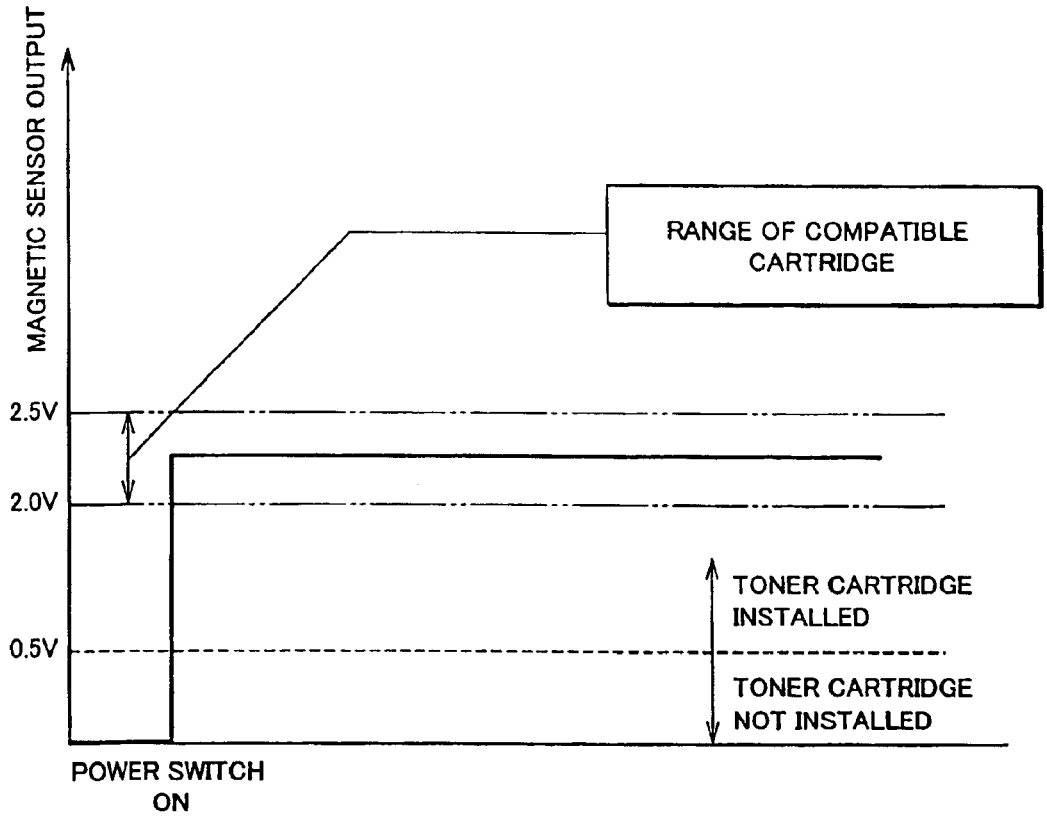
FIG. 3 is a graph showing the relationship between magnetic sensor outputs and the compatibility of a toner cartridge.

For example, as shown in FIG. 3, when the magnetic sensor 22 detects an output voltage of higher than or equal to 0.5 V., it determines that the toner cartridge 16 has been installed. Then, when the magnetic sensor 22 detects the output voltage in the range of 2.0 to 2.5 V., it determines that the inserted toner cartridge 16 is compatible with the image forming apparatus 1.

The magnetic sensor 22 is preset to output the voltage of 2.0 to 2.5 V in the manufacturing process by employing a standard magnetic chip 18. Furthermore, when there is a wide variation in outputs of the magnetic sensor 22 and respective devices, another type of sensor, which is capable of changing the output voltage of the magnetic sensor 22, is adopted. Or, the data, which is recorded in RAM of the microcomputer 23, is rewritten so as to change the criterion.

Operation of the image forming apparatus 1 in the above construction will be described in the following.

By turning a power switch on, the copy machine will be supplied with power, and carries out a normal operation. When the toner cartridge 16 needs to be replaced for a shortage of toner, the old toner cartridge 16 is removed and replaced by a new toner cartridge 16. When the toner cartridge 16 equipped with the magnetic chip 18 is installed by the user to the engagement portion of the body of the image forming apparatus 1, the magnetic chip 18 is located in a position facing the magnetic sensor 22. Accordingly, the magnetic sensor 22 detects magnetism of the magnetic chip 18 and outputs a signal in an electrical form in accordance with the magnetic resistance to the microcomputer 23.

Figure 4:
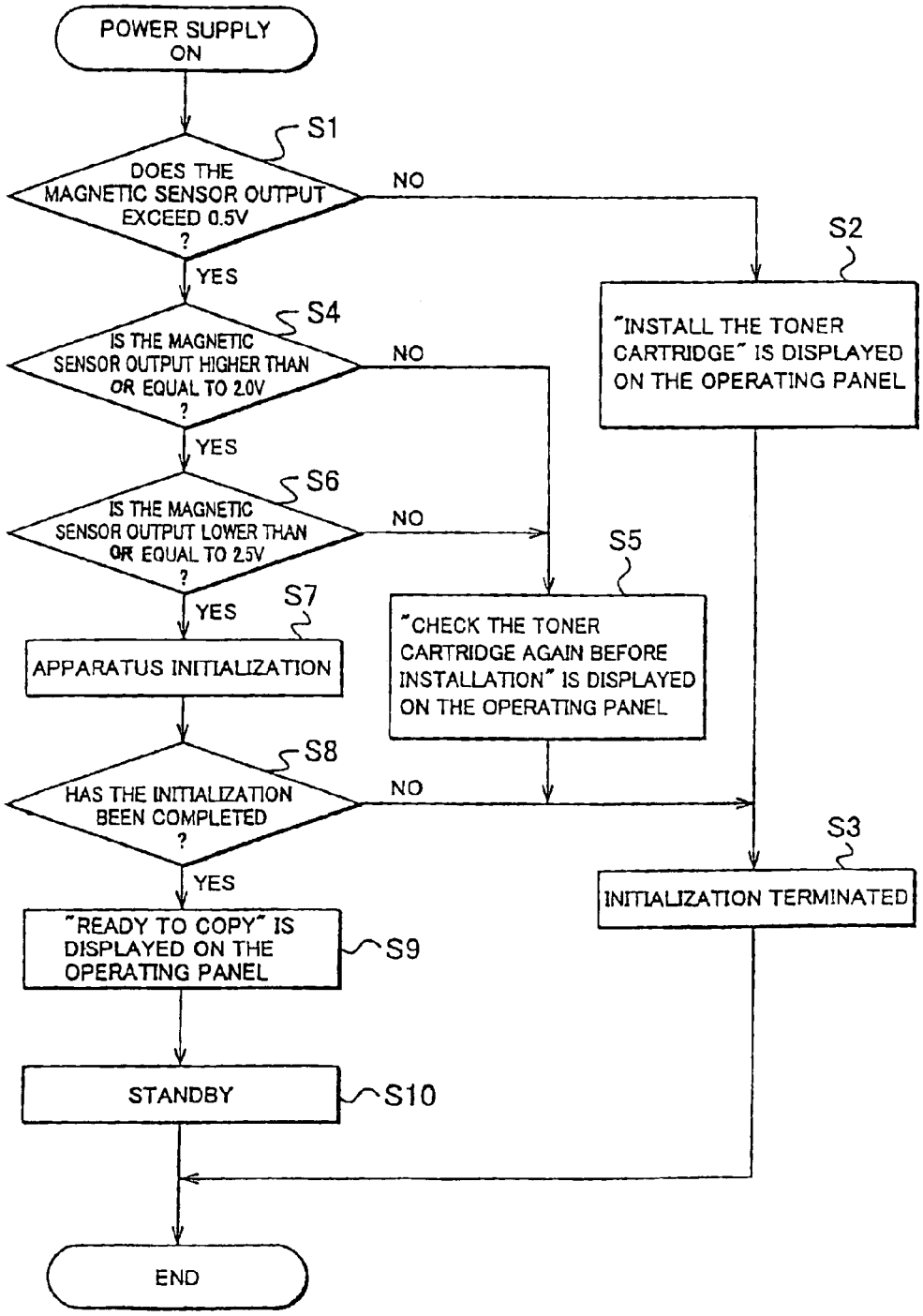
FIG. 4 is a flow chart showing a microcomputer procedure of a preferred embodiment of an image forming apparatus in accordance with the present invention.

Referring to the flow chart of FIG. 4, the procedures of the microcomputer 23 of the identifying means 21 in these steps will be described below.

The microcomputer 23 first verifies whether the output voltage of the magnetic sensor 22 exceeds 0.5 V (Step S1). An output voltage not exceeding 0.5 V indicates that the toner cartridge 16 has not been installed and a message, for example, "Install the toner cartridge" or the like is displayed on a display part (Step S2) of the operating panel. The initialization operation is then terminated (Step S3).

When the microcomputer 23 verifies the output voltage exceeds 0.5 V, it continues to verify whether the output voltage is higher than or equal to 2.0 V (Step S4). An output voltage not higher than or equal to 2.0 V indicates that an incompatible toner cartridge 16 has been installed and the message, for example, "Check the toner cartridge again before installation" or the like is displayed on the display part on the operating panel (Step S5). The initialization operation is then terminated (Step S3).

When the output voltage is higher than or equal to 2.0 V, the microcomputer 23 further verifies whether the output voltage is lower than or equal to 2.5 V (Step S6). If the output voltage is not lower than or equal to 2.5 V, the microcomputer 23 returns to the above mentioned step S5 and displays the previously mentioned message informing that the toner cartridge 16 is not compatible. When the output voltage is lower than or equal to 2.5 V, the microcomputer 23 carries out the apparatus initialization operation (Step S7).

Then, the microcomputer 23 verifies whether the apparatus initialization has been completed without any problem (Step S8). If the apparatus initialization has not been completed, the microcomputer 23 returns to the previously mentioned step S3 and terminates the initialization operation. When the apparatus initialization has been completed, the microcomputer 23 displays a message "Ready to copy" or the like on the display part of the operating panel (Step S9). The microcomputer 23 then switches to a standby mode (Step S10) to complete the procedure.

As mentioned above, the shapes of the toner cartridge 16 could be generalized for the image forming apparatus 1. This eliminates the need for manufacturing many types of toner cartridges 16, thus achieving a reduction of the development cost. This leads to a reduction in the manufacturing cost, therefore allowing an inexpensive toner cartridge 16 to be supplied to the users.

Since the image forming apparatus 1 is capable of determining both the compatibility of the toner cartridge 16 and the installation thereof at the same time with an identical means, it eliminates the need for introducing a means specifically for determining the installation of the toner cartridge 16. Therefore, appropriate messages shall be provided to the users.

Also, as the image forming apparatus I does not use a magnetic recording medium, it eliminates problems such as (a) that related to magnetism which is caused by components using a magnet and a magnet coil, (b) constraints for installing space and (c) external influences, thus allowing a stable determination.

Furthermore, since the magnetic sensor 22 detects information of the magnetic chip 18 without contacting the magnetic chip 18, it is not subjected to an abrasive degradation, thus achieving a stable operation for a long period of time and an improvement of the reliability of the image forming apparatus 1.

Additionally, unlike the case in which an optical bar code device or the like is employed, the image forming apparatus I does not employ any complex and costly device, thus achieving a reduction in the manufacturing cost.

In the above mentioned preferred embodiment of the image forming apparatus 1 according to the present invention, while the magnetic chip 18 is embedded in the toner cartridge 16, it may be attached to the surface of the toner cartridge 16 using an adhesive tape or agent and the like. Thus, the magnetic chip 18 can be installed at an optional position as in the case with the magnetic sensor 22.

Similarly, while the compound ratio of magnetic powder and non-magnetic powder, from which the magnetic chip 18 is composed, is set within the range of 2 through 2.5 V in the previously mentioned preferred embodiment, it may be compounded at different ratios if necessary. In this case also, the identical operation and effect of the abovementioned preferred embodiment could be obtained.

What is claimed is:

1. A replaceable toner cartridge for use with an image forming apparatus to be identified by identifying means, the toner cartridge comprising:

identification information recording means for recording information to identify a type of the toner cartridge, wherein said identification information recording means is a magnetic member made from magnetic powder and nonmagnetic powder compounded at an appropriate ratio at which a predetermined magnetic resistance is maintained.

2. The toner cartridge according to claim 1, wherein the magnetic resistance of the magnetic member is detected by a magnetic sensor provided to the identifying means of the image forming apparatus without contacting with the magnetic member.

3. The toner cartridge according to claim 2, wherein whether the toner cartridge has been installed in the image forming apparatus, is determined by the magnetic sensor by verifying whether the magnetic resistance of the magnetic member is higher than or equal to a predetermined level.

4. The toner cartridge according to claim 3, wherein whether the toner cartridge is compatible for the image forming apparatus, is determined by the magnetic sensor by verifying whether the magnetic resistance of the magnetic member is higher than or equal to a predetermined level, and whether the magnetic resistance of the magnetic member is within a range of criterion.

5. A replaceable toner cartridge for use with an image forming apparatus to be identified by identifying means, the toner cartridge comprising:

an identification chip for recording information to identify a type of the toner cartridge, the information of the identification chip is read by the identifying means of the image forming apparatus for identifying the type of said toner cartridge so as to determine the compatibility of said toner cartridge, wherein said identification chip is a magnetic chip made from magnetic powder and non-magnetic powder compounded at an appropriate ratio at which a predetermined magnetic resistance is maintained.

6. The toner cartridge according to claim 5, wherein the magnetic resistance of the magnetic chip is detected by a magnetic sensor provided to the identifying means without contacting with the magnetic chip.

7. The toner cartridge according to claim 6, wherein whether the toner cartridge has been installed in the image forming apparatus, is determined by the magnetic sensor by verifying whether the magnetic resistance of the magnetic chip is higher than or equal to a predetermined level.

8. The toner cartridge according to claim 7, wherein whether the toner cartridge is compatible for the image forming apparatus, is determined by the magnetic sensor by verifying whether the magnetic resistance of the magnetic chip is higher than or equal to a predetermined level, and whether the magnetic resistance of the magnetic chip is within a range of criterion.

* * * * *